US005810173A

United States Patent [19]

Stevens et al.

[11] Patent Number: 5,810,173

[45] Date of Patent: Sep. 22, 1998

[54] METHOD AND SYSTEM FOR PROCESSING DOCUMENTS

[75] Inventors: Albert F.. Stevens; Robert R. Dewitt, both of Moorestown; James G. Robertson, Braddock; Jeffrey L. Chodack, Moorestown, all of N.J.; Ilya Chachkes, Huntingdon Valley; Marjory A. McCahill, Philadelphia, both of Pa.; George L. Hayduchok, Mt. Holly, N.J.

[73] Assignee: Opex Corporation, Moorestown, N.J.

[21] Appl. No.: 499,343

[22] Filed: Jul. 7, 1995

[51] Int. Cl.[6] ..... B07C 5/02; B65H 9/14

[52] U.S. Cl. ..... 209/539; 209/559; 209/630; 209/900; 209/942; 271/229

[58] Field of Search ..... 209/539, 577, 209/583, 584, 587, 629, 630, 657, 701, 702, 703, 705, 900, 939, 942, 540, 545, 559; 198/836.1, 836.3; 271/225, 226, 227, 229

[56] References Cited

U.S. PATENT DOCUMENTS

| | | | |
|---|---|---|---|
| 4,863,037 | 9/1989 | Stevens et al. | 209/900 X |
| 4,921,107 | 5/1990 | Hofer | 209/900 X |
| 5,115,918 | 5/1992 | DeWitt et al. | 209/540 X |
| 5,156,515 | 10/1992 | Charron et al. | 414/412 |
| 5,207,331 | 5/1993 | Teegarden et al. | 209/540 X |
| 5,240,116 | 8/1993 | Stevens et al. | 209/534 |
| 5,310,062 | 5/1994 | Stevens et al. | 209/584 |
| 5,439,118 | 8/1995 | York | 209/900 X |
| 5,441,159 | 8/1995 | DeWitt et al. | 209/584 |
| 5,460,273 | 10/1995 | Stevens et al. | 209/900 X |
| 5,547,063 | 8/1996 | Bonnet | 198/836.1 X |
| 5,558,232 | 9/1996 | Stevens et al. | 209/630 X |

FOREIGN PATENT DOCUMENTS

| | | | |
|---|---|---|---|
| 258895 | 8/1988 | Germany | 209/584 |

*Primary Examiner*—Joseph N. Valenza
*Assistant Examiner*—Tuan Nguyen
*Attorney, Agent, or Firm*—Dann, Dorfman, Herrell and Skillman, P.C.

[57] ABSTRACT

A system for processing documents is provided for use in remittance processing of bulk mail. An extraction unit opens envelopes and extracts the envelope contents, typically in the form of a pair of documents such as an invoice stub and an accompanying check. The extraction unit discards the opened envelopes and feeds the pair of documents in parallel disposition to a document sorting apparatus. The paired, parallel documents are conveyed through a document shifter in the form of nip rollers wherein one document of each pair is at least partially shifted relative to the other document of the pair to expose at least a portion of the covered document to an operator. The documents are then conveyed to a viewing area where the operator visually inspects each pair of documents and manually designates a selected path of movement using a manual input device. From the viewing area, the documents are conveyed to a staging area where the documents may be redirected along another path of movement by operator use of the manual input device. From the staging area, the pairs of documents are conveyed to selected bins in response to the manual inputs by the operator.

34 Claims, 11 Drawing Sheets

METHOD AND SYSTEM FOR PROCESSING DOCUMENTS

FIELD OF THE INVENTION

The present invention relates to a system and method of processing documents and, more specifically, to an apparatus and method for sorting documents wherein documents are conveyed to a predetermined viewing area to permit visual inspection of the documents by an operator and are thereafter sorted to selected output areas in response to manual input from the operator following the visual inspection of the documents.

BACKGROUND OF THE INVENTION

Due to the large quantity of mail received by many companies, there has long been a need for efficient sorting of incoming mail. Document sorting has become particularly important in the area of remittance processing.

Utility companies, phone companies, and credit card companies routinely receive thousands of payment envelopes from their customers on a daily basis. Typically, a customer payment envelope contains an invoice stub and some type of customer payment, usually in the form of a bank check or money order. In practice, some customers pay the full amount of the invoices while other customers only make partial payments. By initially separating full payments from partial payments, more efficient downstream processing of the customer invoices and payments can be achieved. For example, full payment checks can frequently be power-encoded whereas partial payment checks generally require hand keying. As a result, an initial sorting of the customer invoices and payment checks on the basis of full or partial payment criteria may be used to increase productivity.

Other types of document sorting based on different sorting criteria may also be desired. For example, customers may inadvertently submit blank checks or incomplete checks that necessitate sorting into yet additional groups.

In a typical sorting procedure the documents to be processed are first extracted from their envelopes and are then oriented in a selected manner. The extraction and orientation of the documents may either be done manually or be done automatically using a high-speed extractor.

Regardless of the manner in which the documents are extracted from the envelopes, subsequent processing is still required to sort the documents into selected groupings, such as a full-pay grouping and a partial-pay grouping. The manual separation and sorting of documents is a laborious and time-consuming process. Consequently, a fully automated approach to sorting documents may not always be cost effective or even desirable in all applications. For example, most checks accompanying invoice stubs are handwritten and even the most advanced automated equipment may not always be capable of reading the handwritten dollar amounts within a desired degree of accuracy at a suitable cost to the user. In other situations, the volume of remittance processing to be performed may not be sufficient to economically justify the cost of fully automated remittance processing equipment.

In accordance with the present invention, an apparatus and method are provided to enable the efficient sorting of documents. In accordance with the present invention, a document sorter is provided that combines automated sorting techniques with manual entry of operator-controlled sorting selections.

SUMMARY OF THE INVENTION

In accordance with the present invention, a system and method are provided for processing documents. In a specific application, the method and system may be used in remittance processing of bulk mail.

The processing system in accordance with the present invention may include an extraction unit for opening envelopes and extracting the envelope contents, typically in the form of a pair of documents such as an invoice stub and an accompanying check. The extraction unit discards the opened envelopes and feeds the pair of documents in a parallel or face to face arrangement to a document sorting apparatus. To ensure that the documents from the extraction unit are properly fed to the sorting apparatus, the extraction unit includes an output conveyor which is alignable in proper registry with the input of a document sorting apparatus. The output conveyer of the extraction unit may be in the form of an output conveyor arm that mates with the input of the document sorting apparatus in proper alignment to ensure a smooth conveyance of the paired, parallel documents from the extraction unit to the document sorting apparatus without impediment.

The paired, parallel documents may also be fed to the sorting apparatus in other ways. For example, the documents may be automatically extracted from their envelopes but manually oriented and fed into the document sorting apparatus. Alternatively, the documents may be manually extracted from the envelopes and then manually fed into the document sorting apparatus in a paired, parallel or face to face arrangement.

The document sorting apparatus is provided to sort the paired documents into selected groupings in response to the manual entry of group designations by an operator. A document transport is provided on the document sorting apparatus for conveying the documents along a selected path of movement. Typically, the documents are conveyed along an exposed work surface of the sorting apparatus.

From the input to the document sorting apparatus, the documents are conveyed through a document shifter where one document of the pair is at least partially shifted relative to the other document of the pair along the path of movement to expose at least a portion of the covered document to the operator. The document shifter may be in the form of a pair of nip rollers which are coordinated to simultaneously advance the covered document and retard the exposed document along the path of movement in order to expose at least a portion of the covered document to an operator. For example, in remittance processing, the invoice stub may be positioned to cover the accompanying check in the parallel or face to face arrangement. As such, the document shifter functions to shift the relative positions of the invoice stub and the check so that the courtesy box on the previously covered check is exposed for visible inspection by the operator.

From the document shifter, the documents are conveyed to a viewing area positioned along the selected path of movement for presenting each pair of the shifted, parallel documents for visual inspection by the operator. In order to facilitate the visual inspection of the documents, the document transport functions to recline the pair of shifted documents into a predetermined angle of viewing, at least at the viewing area. While the shifted pair of documents are positioned at the viewing area, the operator visually inspects the pair of documents to effect visual detection of documents having a desired characteristic. For example, the operator may compare the amount showing in the courtesy box of the partially exposed check with the amount showing on the invoice stub to determine whether the document pair constitutes a full pay or a partial pay. To further facilitate the visual inspection of the documents, the document transport may function to pause the documents at the viewing area.

An operator input device is provided to enable the operator to manually designate a selected path of movement for each pair of documents presented to the operator at the viewing area. The manual input device may be in the form of a keypad positioned on the work surface of the apparatus. Other forms of manual input devices may also be employed, such as a hand-held control, a foot pedal control, or a voice activation unit for the operator. In order to accommodate both left-handed and right-handed operators, a surface-mounted keypad is provided that is removably positionable on the sorting apparatus in a position on the left side of the viewing area for left-handed operators and a position on the right side of the viewing area for right-handed operators. To facilitate repositioning, the surface-mounted keypad may include external mounting flanges that are supported by countersunk ledges at an opening on the surface of the sorting apparatus.

The operator input device provides a set of actuator buttons to enable operator input to the sorter apparatus. At the viewing area, the operator visually inspects the pair of documents and manually actuates the appropriate actuator button on the input device to designate into which group the pair of documents at the viewing area should be sorted. Actuating the input device functions to designate a particular path of movement corresponding to the selected sort group for the pair of documents that are positioned at the viewing area. In one mode of operation, actuation of the input device causes the pair of documents to be conveyed to a staging area, while the next set of documents is advanced from the document shifter to the viewing area. Prior to activating the input device, the pair of documents may be temporarily removed from the viewing area for reorientation or other adjustments and then placed back into position at the viewing area without adversely affecting the operation of the sorting apparatus. In a second mode of operation, the pair of documents may be manually pulled from the viewing area thereby causing the document transport to convey the next set of documents automatically from the document shifter to the viewing area. The removed set of documents can be manually placed into a selected offsort location.

The staging area is provided a selected distance from the viewing area along the path of movement. The staging area permits the operator to redirect the movement of the pair of documents along a path of movement that is different from the one originally selected when the documents were in the viewing area. For this purpose, an override actuator in the form of an override button is provided to enable the operator to manually override or cancel the original designation entered when the documents were at the viewing area. The operator then has an opportunity to make a fresh entry on the input device to designate a selected group for the pair of documents in the staging area. Upon actuation of the override button, an indicator such as a warning light may be provided to the operator.

In a first mode of operation the indicator will remain on following activation of the override button to alert the operator to the fact that the next entry on the input device will be used to designate a selected group for the documents in the staging area and will not be used to designate a selected group for the documents in the viewing area. In this first mode of operation, the pair of documents may be removed from the staging area for reorientation or other adjustments and manually placed back into position at the staging area prior to the manual actuation of the input device to designate the new selected path of movement. After designating a path of movement for the documents in the staging area, the indicator turns off and the operator may then use the input device to select a path of movement for the documents still positioned at the viewing area.

In a second mode of operation, actuation of the override button may automatically designate a predetermined path of movement, such as a reject bin, for the documents in the staging area. In this second mode of operation, an indicator in the form of a momentary or blinking light may be provided to the operator to indicate the automatic redirection of the documents in the staging area along the predetermined path of movement.

In a third mode of operation, the documents in the staging area may be manually pulled from the document sorter either before or following manual actuation of the override button. In this third mode of operation, the removal of the documents from the staging area will be detected by a detector. The document conveyor will then ignore any designation entered for the removed documents and will then advance the set of documents in the viewing area to the staging area upon operator input while simultaneously advancing the set of documents at the document shifter to the viewing area.

An output area is provided on the sorting apparatus for accumulating the pairs of documents into the designated groups. For this purpose, a stacker is provided having a number of output bins for stacking the pairs of documents in the designated groups. The pairs of documents are directed to the appropriate output areas by path selection gates positioned along the path of movement. The path selector gates function to direct movement of pairs of documents along the selected path of movement in response to the actuation of the manual input device by the operator.

BRIEF DESCRIPTION OF THE DRAWINGS

The foregoing summary as well as the following detailed description of the preferred embodiments of the present invention will be better understood when read in conjunction with the appended drawings, in which.

DETAILED DESCRIPTION OF THE PREFERRED EMBODIMENTS

Figure 1:
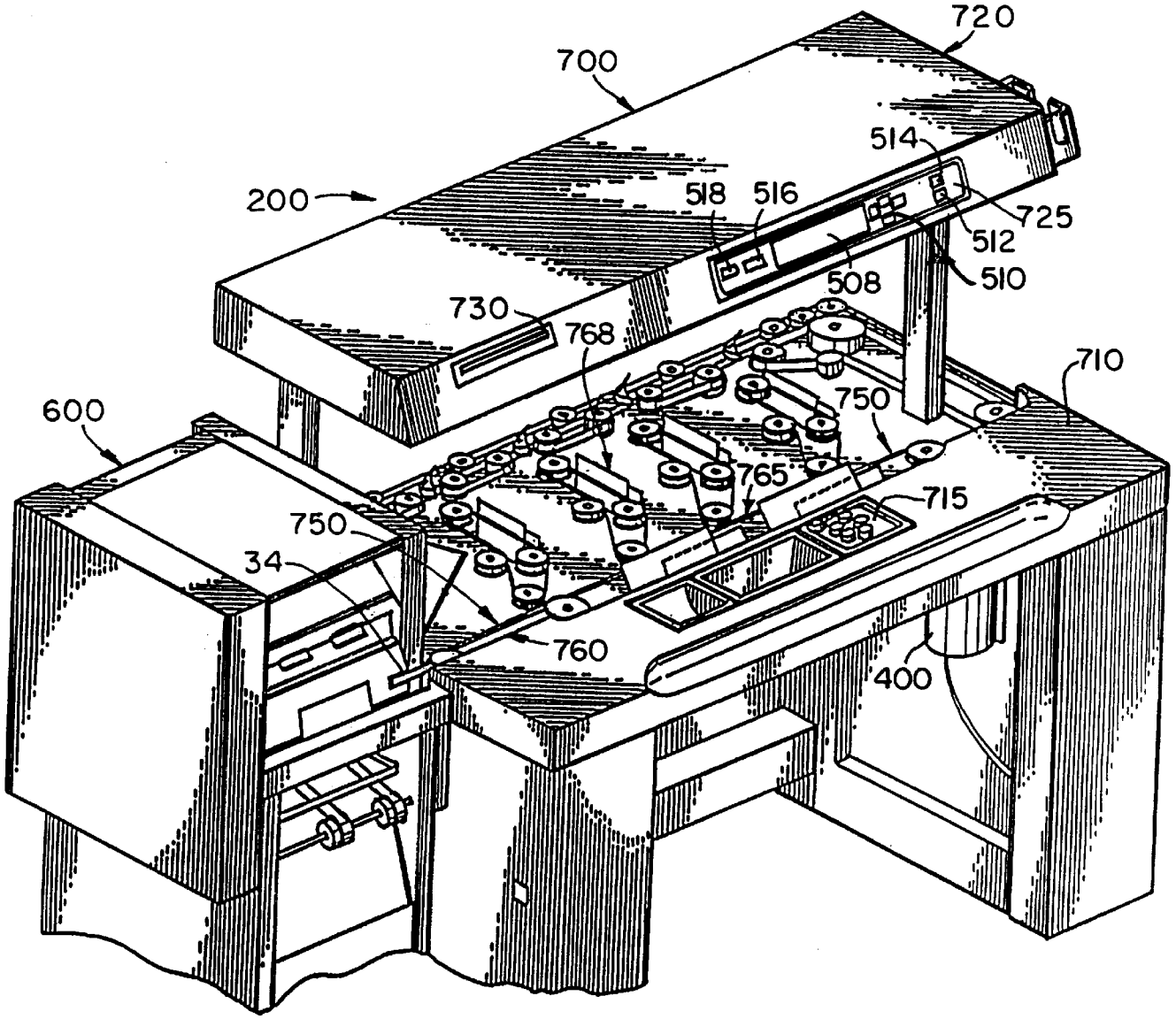
FIG. 1 is a schematic perspective view of a document processing apparatus in which a document extraction unit is coupled with a document sorter unit having its top cover removed to reveal internal operating mechanisms of the document sorter unit.
Figure 2:
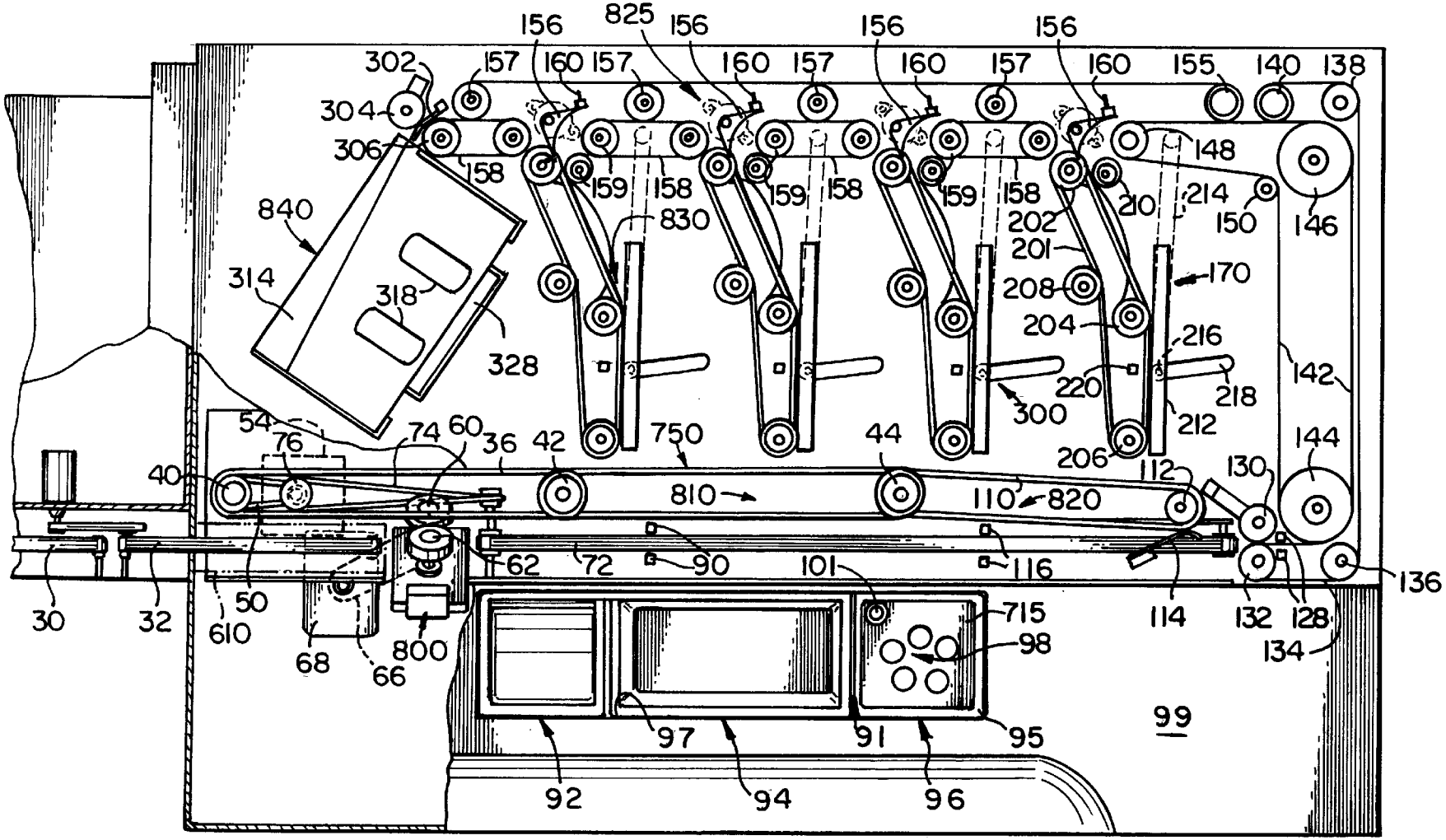
FIG. 2 is a schematic top plan view, in partial section, of the document sorter unit having its top cover and hood removed to reveal internal operating mechanisms of the document sorter unit as coupled with the document extraction unit as shown in fragment and partial section.
Figure 3:
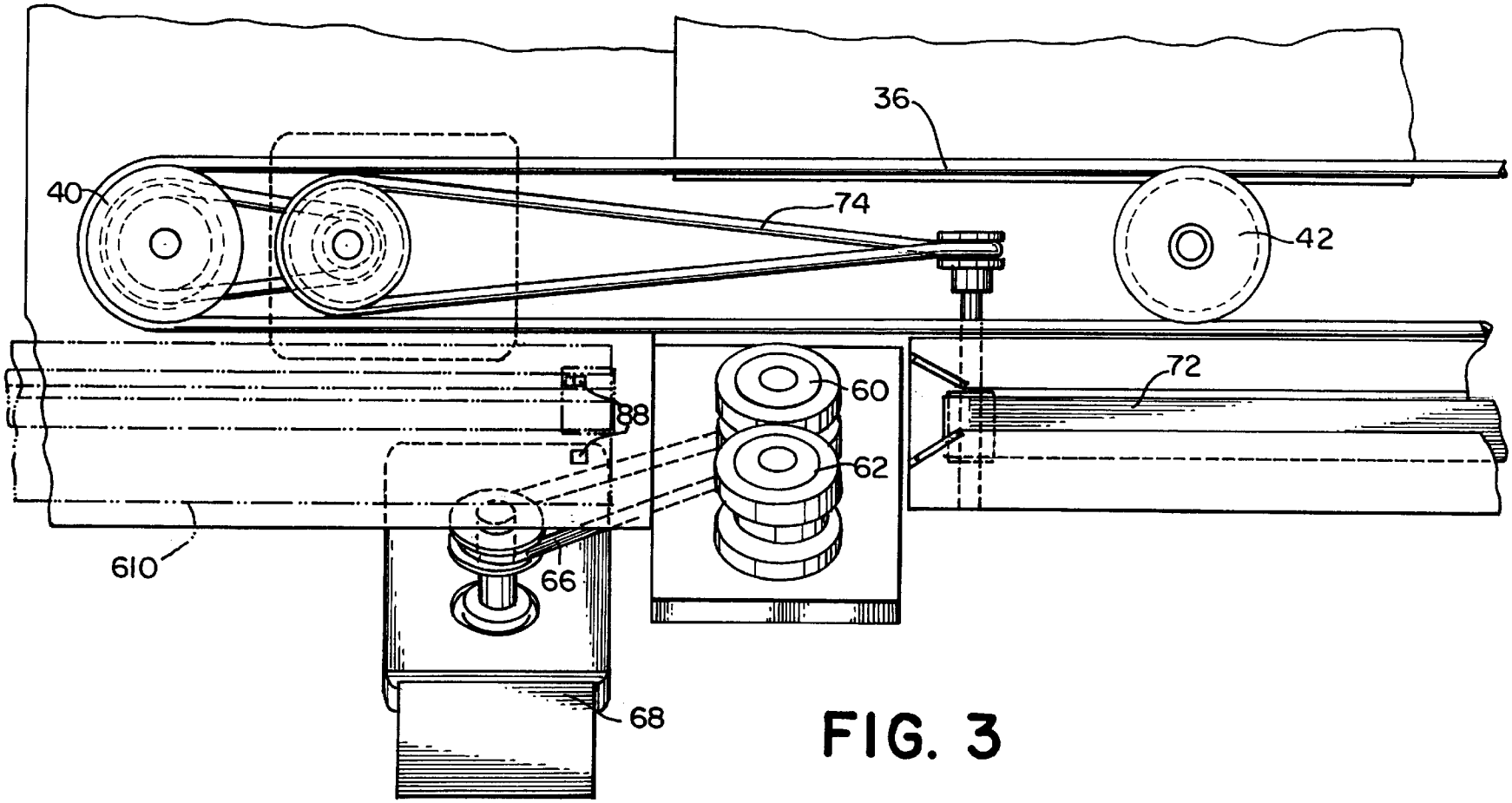
FIG. 3 is an enlarged, fragmentary schematic top plan view of the document sorter unit having its front shelf, top cover, hood, and various support structures removed to better illustrate a document shifter mechanism, as shown in FIG. 2, and a section of a document conveyor, as also shown in FIG. 2.
Figure 4:
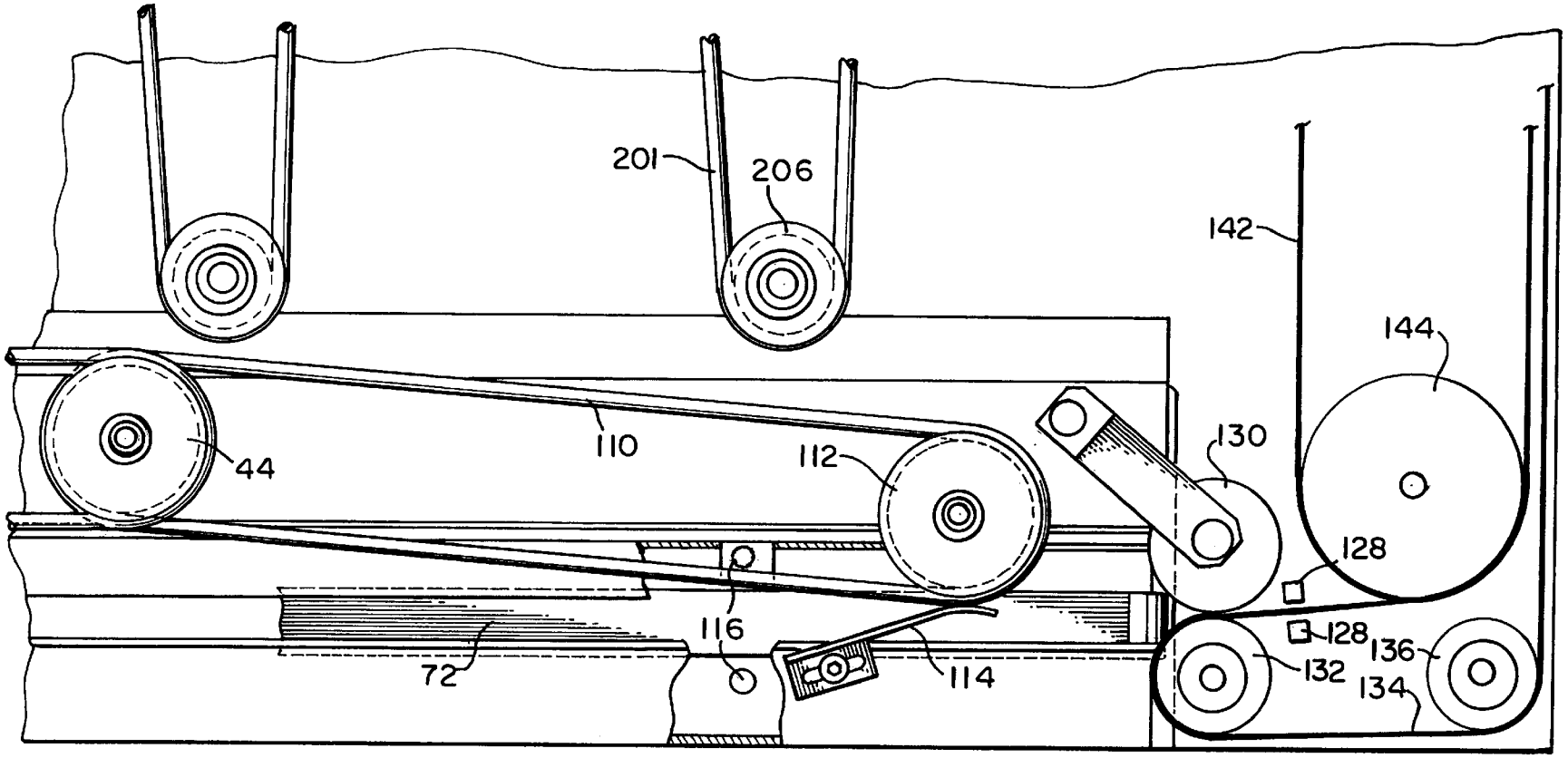
FIG. 4 is an enlarged, fragmentary schematic top plan view of the document sorter unit having its front shelf, top cover, hood and various support structures removed to better illustrate a section of the document conveyor, as shown in FIG. 2.

As best illustrated in FIGS. 1 and 2, a document processing apparatus, generally designated 200, is provided for processing documents. In general operation, the document processing apparatus 200 functions to perform batch processing of mail. More specifically, the document processing apparatus initially functions to extract documents from envelopes and then functions to sort the documents into selected groups in response to manual inputs from an operator. In remittance processing applications, the document processing apparatus 200 extracts a pair of documents typically in the form of an invoice stub and an accompanying payment check from each of the envelopes. Each pair of documents is then sorted into selected groups based upon a selected criteria such as full-payment or partial-payment. Based upon visual detection of the selected criteria by the operator, the documents are conveyed to selected output areas in response to manual inputs provided by the operator.

As shown in FIGS. 1 and 2, the document processing apparatus 200 includes a document extraction apparatus 600 which is coupled with a document sorting apparatus 700. In general, the document extraction apparatus 600 receives a batch of envelopes. The extraction apparatus 600 functions to open each envelope from the batch and to extract the contents in the form of a pair of documents from each opened envelope. The extraction apparatus 600 then functions to output each pair of documents in a generally parallel or face to face arrangement. The parallel, paired documents are then output in a sequential manner from the extraction apparatus 600.

From the output of the extraction apparatus 600, the documents are then fed into an input of the document sorting apparatus 700. In general the document sorting apparatus 700 functions to sort the pairs of documents, and particularly mated pairs of documents, into predetermined groups. As shown in FIG. 1, the document sorting apparatus 700 provides a work station for an operator so that manual control input may be effected by the operator to control operation of the sorting apparatus 700. The document sorting apparatus 700 provides a desk-level or counter-level work surface 710 so that the operator may be comfortably seated at the work station during periods of operation of the sorter.

The sorter 700 provides a knee hole underneath the work surface 710 to permit the operator to draw closer to the apparatus during operation. An operator input device 715 is removably mounted at a convenient location along the work surface 710. A hood 720 is supported above the apparatus at a position that is generally eye level to a seated operator. An operation control and display panel 725 is mounted on the front of the hood 720 to permit easy access and viewing by the seated operator. The operation control and display panel 725 enables an operator to enter various modes of operation or run information to the apparatus while various output information is displayed on the operation control and display panel 725. An optional printer at printer port 730 may also be mounted on the front of the hood 720.

A document transport, generally designated 750 conveys documents along a selected path of movement generally along the top surface of the document sorter. More specifically, the document transport 750 functions to convey documents from an input area 760 at the left side of the document sorter 700 through a central processing area, generally designated 765 to an output area, generally designated 768. At the central processing area 765 the documents are initially conveyed through a document shifter mechanism, generally designated 800. The document shifting unit 800 functions to shift one of the pair of documents relative to the other document of the pair along the path of movement to expose at least a portion of the originally covered document. Alternatively, the shifter unit 800 may be utilized to completely singulate the paired, parallel documents into a serial orientation. The documents are shifted by the shifting mechanism 800 to preferably expose the courtesy box of an underlying check so that the amount of money appearing in the courtesy box can be compared to an amount on an overlying invoice stub.

From the shifter mechanism 800, the shifted, paired documents are conveyed by the document transport 750 to a central viewing area, generally designated 810, as best shown in FIG. 2. At the viewing area 810 the operator can visually inspect the shifted pair of documents for a selected criteria. For example, the operator can compare the amount of the check with the amount on the invoice stub to determine whether the payment is a full pay or a partial pay. Based upon visual detection of the selected criteria, the operator designates a selected path of movement for a pair of documents in the viewing area by manual entry on the operator input device 715.

From the viewing area 810, the shifted pair of documents are then conveyed by the document transport 750 to a staging area generally designated 820. The documents may be paused at the staging area 820 in order to permit the operator to change the input designation for the pair of documents originally entered by the operator when the documents where positioned in the viewing area 810. The staging area 820 is spaced a predetermined distance from the viewing area 810 along the path of movement within easy reach of the operator. While the shifted pair of documents are located at the staging area 820 the operator may override the original designation by using the input device 715. Once the original designation assigned to the pair of documents at the viewing area has been canceled the operator may enter a new designation for the documents or the documents may be automatically conveyed to a predetermined destination such as the passive output bin 840.

From the staging area 820 the documents are conveyed to an output area 768 provided by a document stacker generally designated 825, which includes a series of sorting bins 830 for accumulating and stacking the documents in a predetermined sorted manner. In simplest operation, the operator may select a particular sorting bin 830 or a particular set of sorting bins 830 through the use of the operator input device 715 when the pair of documents is positioned at the viewing area 810 or the staging area 820.

Document Extraction Apparatus

The operation of the document extraction apparatus 600 will now be considered in greater detail. In order to process documents contained within envelopes, a batch of envelopes are loaded into the document extraction apparatus 600. The document extraction apparatus then functions to open and extract the contents from each envelope. The extracted pair of documents are then fed in a selected generally parallel or face to face arrangement onto an output conveyor arm 610. Optional sensors 88 may be provided at the end of the output conveyor arm 610 to detect the passage of documents at the end of the conveyor arm. As best shown in FIG. 2 the document conveyor arm 610 is configured to plug into the document sorting apparatus 700 in proper position and alignment to sequentially feed pairs of documents in face to face orientation for the document extraction apparatus 600 to the document sorting apparatus 700.

The document extraction apparatus 600 is preferably of the type marketed as model number 501 by the Omation division of Opex Corporation of Moorestown, N.J. The operation of the document extraction apparatus is described in greater detail in U.S. Pat. No. 5,156,515 which is incorporated herein by reference. In basic operation, the document extraction apparatus 600 requires the top side of each envelope to be pre-slit. A batch of the pre-slit envelopes are loaded into the extraction apparatus 600. During a single cycle of the extraction apparatus, a piece of mail is fed through a cutting station in order to cut intact edges of the envelope in order to open the envelope. From the cutting station, the opened envelope is fed to an extraction station 28 where the opened envelope is separated from the pair of documents. The opened envelope is then sent through a detector to verify that there are no documents left inside the envelope. The envelope is then discarded from the extraction apparatus. The paired documents extracted from the opened envelope are dropped in a generally parallel or face to face arrangement onto an output transport track 30 and the next envelope is staged in the cutting station. The output transport track 30 runs longitudinally in a generally horizontal orientation. The output track supports the parallel pair of documents from underneath the documents as the documents are dropped onto the track 30. The output transport track 30 functions to convey the paired, parallel documents unto a second output transport track 32 provided along the output conveyor arm 610. The second output transport track 32 runs longitudinally in a generally horizontal orientation in alignment with the first track 30. The movement of the first and second output transport tracks are coordinated to ensure a smooth transitional conveyance of the pair of documents from the first transport track 30 to the second transport track 32. The second output track 32 supports the parallel pair of documents from underneath and functions to convey the parallel pair of documents to the document sorting apparatus 700.

Document Sorter Apparatus

The operation of the document sorter apparatus 700 will now be considered in greater detail. The movement of the output track 32 of the document extraction apparatus 600 is coordinated with the movement of the document conveyor, generally designated 750, of the document sorter apparatus 700 in order to ensure a smooth transitional conveyance of documents from the output track 32 into the document sorter apparatus 700. As the parallel pair of documents are conveyed by the transport track 32 a metal guide 34 supported on the document extraction apparatus 600 functions to lean the parallel pair of documents back against an O-ring conveyor element 36 provided by the document transport 750 of the document sorter apparatus 700. The O-ring 36 extends longitudinally generally in parallel with the transport track 32. The O-ring 36 is slightly elevated relative to the transport track 32 and is offset from the transport track 32 in a generally transverse direction relative to the path of movement of both the transport track 32 and the O-ring 36. The elevated offset of the O-ring 36 enables documents to be laid back against the O-ring 36 at a selected angle of inclination with an upper portion of the documents resting against the O-ring 36. Movement of the O-ring 36 is coordinated with the movement of the transport track 32 so that the transport track 32 and O-ring 36 cooperate to simultaneously move the document along the selected path of movement. The elevated offset between the O-ring 36 and the transport track 32 permits the documents to be supported at a predetermined viewing angle of approximately 35 degrees relative to vertical.

Figure 5:
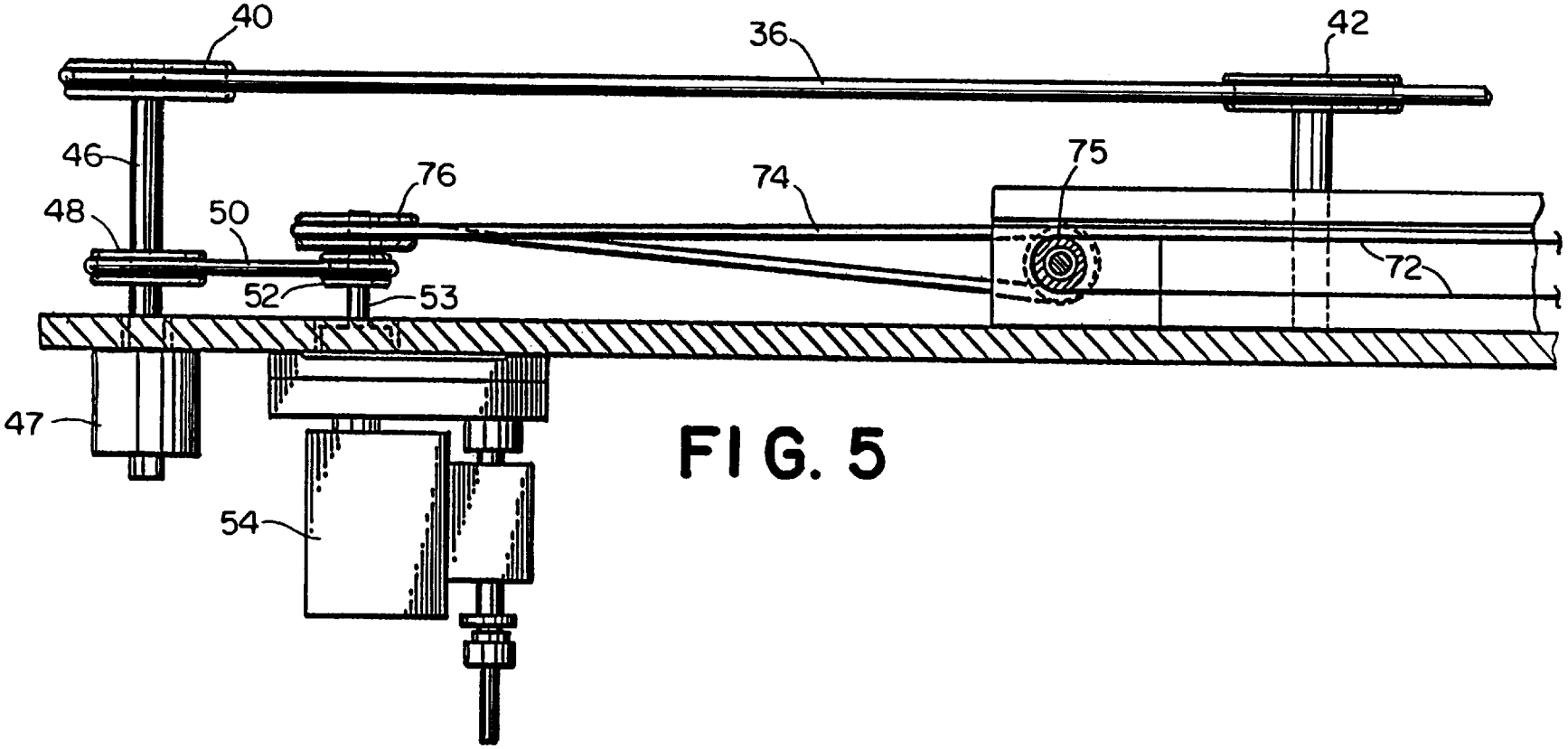
FIG. 5 is an enlarged, fragmentary schematic front elevational view, in partial section, depicting a drive mechanism for the document conveyor of the document sorter unit.
Figure 6:
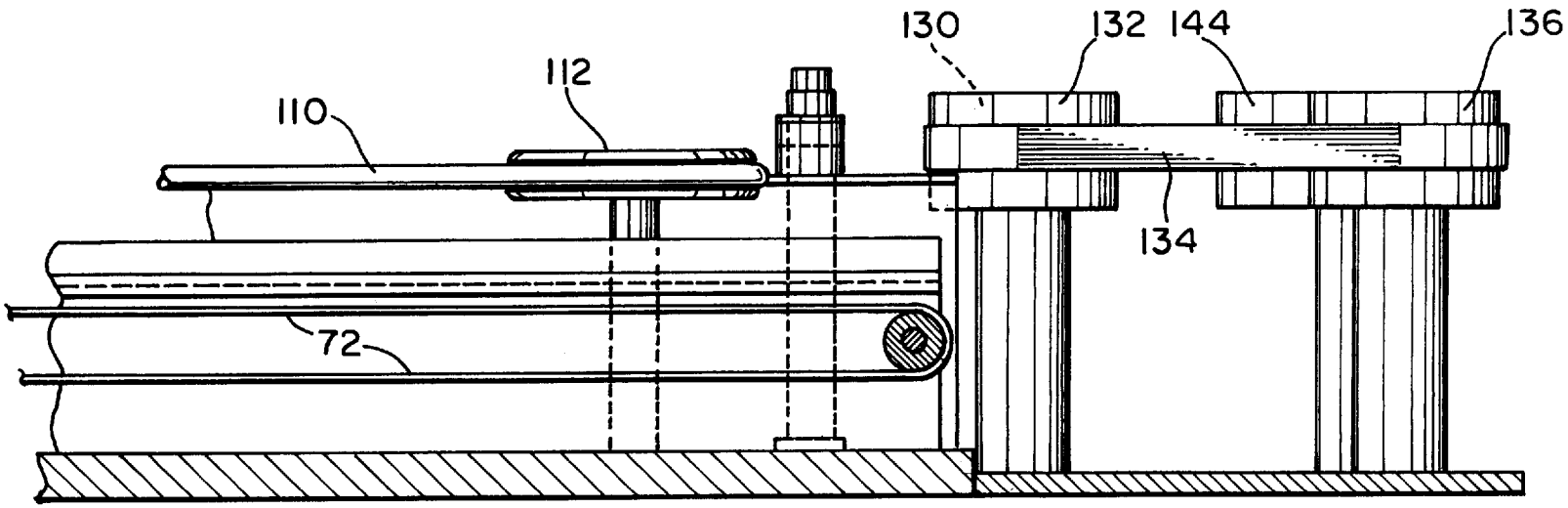
FIG. 6 is an enlarged, fragmentary schematic front elevational view, in partial section, depicting a section of the document conveyor of the document sorter unit.
Figure 7:
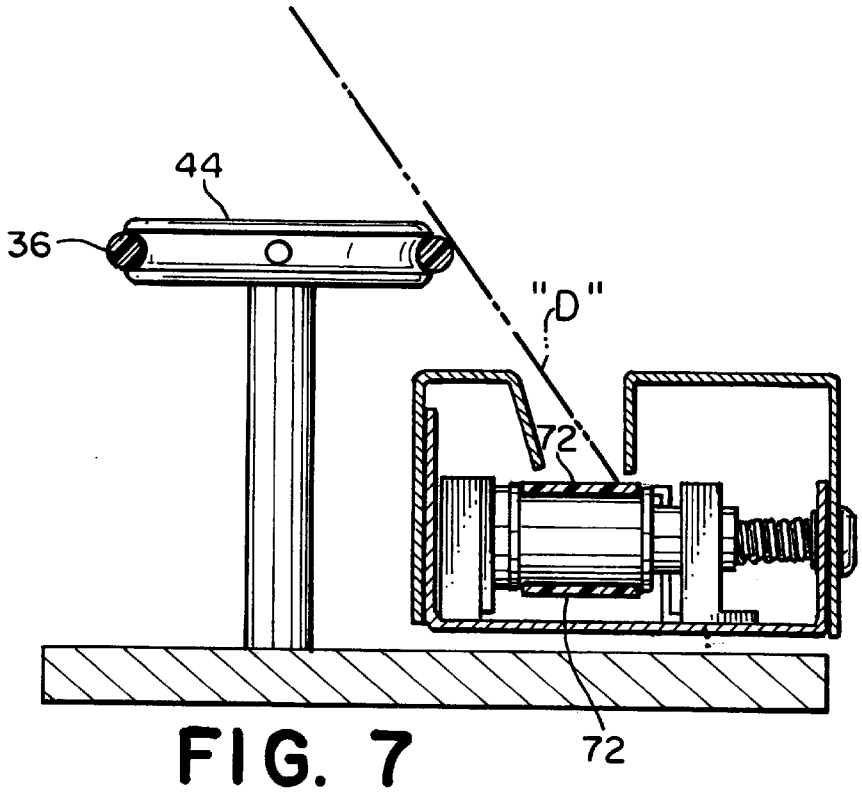
FIG. 7 is an enlarged, cross-sectional, schematic side elevational view depicting a document transport track and O-ring conveyor for the document conveyor of the document sorter unit.

As best shown in FIG. 2, the O-ring 36 is carried by an O-ring drive pulley 40, an O-ring idler 42 and a double O-ring idler 44. As shown in FIG. 5, the O-ring drive pulley 40 is mounted on a drive shaft 46 journaled in bearing 47. A second, smaller diameter O-ring drive pulley 48 is also mounted on the drive shaft 46 below drive pulley 40. A second O-ring 50 is wrapped around the O-ring drive pulley 48 and an O-ring drive pulley 52 carried on drive shaft 53 of an O-ring track drive motor 54 which is soft-mounted to a supporting base plate with grommets to reduce vibration and noise. As such, the drive motor 54 functions to drive the movement of the O-ring conveyor 36.

Shifting Mechanism

The operation of the shifting mechanism will now be considered in greater detail. Coordinated movement of the O-ring conveyor 36 in cooperation with the movement of the second transport track 32 conveys the pair of parallel documents to the shifting mechanism 800 positioned along the path of movement. The shifting mechanism 800 functions to shift one of the paired parallel documents relative to the other of the paired parallel documents along the path of movement to expose at least a selected portion of the covered document of the pair for visual inspection by an operator.

Figure 8:
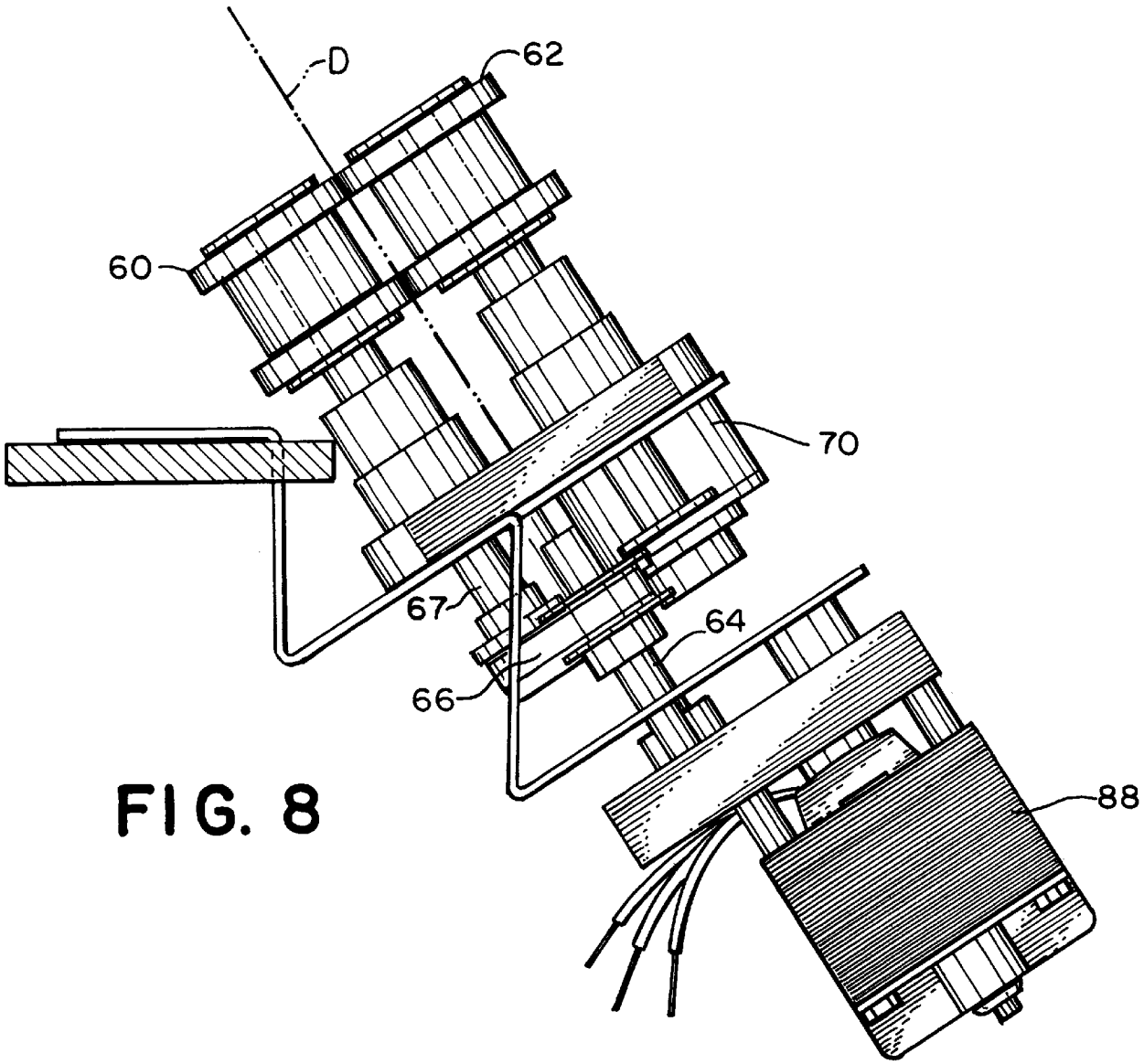
FIG. 8 is an enlarged, cross-sectional, schematic side elevational view depicting the document shifter mechanism of the document sorter unit.

By shifting the pair of documents, a characteristic or criteria appearing on a portion of the covered document from the parallel pair of documents may be visually compared to a characteristic or criteria appearing on the exposed document of the parallel pair of documents. Relative shifts in positions of the paired parallel documents are effected by passing the paired parallel documents through a nip formed by a pair of nip rollers in the form of a drive or feed wheel 60 and a cooperating brake wheel 62 having different coefficients of friction. The brake wheel 62 has a greater coefficient of friction than the feed wheel 60 to ensure that the document of a pair of documents which contacts the brake wheel is maintained in position after the other document of a pair of documents is completely passed through the nip by the feed wheel 60. As a result, complete singulation of the pair of documents may be effected. As the documents are conveyed to the nip, the wheels 60 and 62 firmly engage the pair of documents and convey the pair of documents along the selected path of movement between the two wheels 60 and 62. As best shown in FIG. 8, the drive wheel 60 and the brake wheel 62 are oriented along the path of movement at the predetermined viewing angle of approximately thirty-five degrees relative to horizontal. The feed wheel 60 engages the covered document of the pair while the brake wheel 62 engages the exposed document of the pair. When the pair of documents is firmly gripped between the drive wheel 60 and the brake wheel 62, the brake wheel is stopped while the feed wheel 60 continues to move thereby causing the exposed document that engages the brake wheel 62 to stop moving, while the covered document of the pair that engages the feed wheel 60 continues to move. A shift in the relative positions of the exposed and covered documents is thereby effected. When the paired documents are shifted by a predetermined amount along the path of movement in order to expose at least a portion of the covered document, the brake wheel 62 is released to again freely rotate so that the overlapping or shingled documents can move together once again along the path of movement. The shifting mechanism can also be used to fully singulate the pair of documents.

As the second transport track 32 and the first O-ring 36 convey the paired documents to the shifting mechanism 800 from the document extraction apparatus 600, the paired documents are lead edged justified by being driven against the nip formed between the feed wheel 60 and brake wheel 62. At the same time, a second set of paired documents is staged onto the first transport track 30 of the document extraction apparatus 600 and a third set of paired documents is then staged at the cutting station of the document extraction apparatus 600. Although the paired documents are usually delivered to the shifting mechanism 800 by the document extraction apparatus 600, the paired documents may also be delivered to the shifting mechanism 800 by other means such as manually depositing the paired documents at the nip between the feed wheel 60 and the brake wheel 62.

As best shown in FIG. 8, the shifting mechanism 800 receives the paired documents at the nip between the feed wheel 60 which is oriented to underlay the pair of documents and the brake wheel 62 which is oriented to overlay the pair of documents. The feed wheel 60 is indirectly driven by a shifter drive motor 68. The shifter drive motor 68 drives a feed shaft 64. A shifter drive belt 66 couples the feed shaft 64 driven by shifter drive motor 68 with a drive shaft 67 on which the feed wheel 60 is mounted. The brake wheel 62 is driven by the feed wheel 60 as a result of contact force between the feed wheel 60 and brake wheel 62 at the nip. A brake is applied to the brake wheel 62 by an electromagnetic brake 70. The brake is applied for a predetermined period of time in order to retard or stop movement of the exposed document which engages the brake wheel 62. While the brake 70 is applied to the brake wheel 62, the feed wheel 60 continues to feed the covered or underlaying document along the path of movement. Consequently, the amount of document shift is selectable for each job by adjusting the time period that the brake 70 is applied to the brake wheel 62. After the paired documents have been shifted into desired relative positions, the electromagnetic brake 70 is turned off. The feed wheel 60 and the brake wheel 62 again turn at the same rate of speed and deliver the shifted pair of documents onto a third transport track 72 which functions in cooperation with the O-ring conveyor 36 to convey the shifted pair of documents to the viewing area 810.

Viewing Area

Operation at the viewing area 810 of the document sorting apparatus 700 will now be considered in greater detail. The viewing area is located on the document sorter apparatus in an area immediately in front of the operator. From the document shifter mechanism 800, the shifted pair of documents are delivered to the viewing area 810 by the third transport track 72 operated in a coordinated manner with the O-ring conveyor 36. The third transport track 72 is oriented generally horizontally and runs longitudinally in substantial alignment with the second transport track 32 of the document extraction apparatus 600. The pair of documents ride on the third transport track while upper portions of the documents lay back against the O-ring conveyor 36 at the selected viewing angle. Accordingly, movement of the O-ring conveyor 36 is coordinated with the movement of the third transport track 72. As best shown in FIG. 5, the third transport track 72 is driven by a twisted O-ring 74 mounted on a track shaft pulley 75 and a track drive pulley 76. The track drive pulley 76 is mounted on the drive shaft 53 of the track drive motor 54 and is thereby driven by drive motor 54.

When the shifted pair of documents initially reach the viewing area 810, the documents trigger the first optical sensor 90 which functions to detect the presence of documents at the viewing area. The sensor 90 remains blocked while the pair of documents are paused in the viewing area. The viewing area 810 is positioned conveniently in front of an operator to allow easy viewing and manipulation of the shifted pair of documents by the operator. To facilitate operator inspection, movement of the pair of documents is stopped at the viewing area. As a result of a visual inspection of the documents at the viewing area 810 for purposes of determining the presence of selected characteristics or criteria, the operator determines to which sorting bin 830 the shifted pair of documents should be conveyed. The operator may select an appropriate destination bin by pressing the specific selection button 98 on the input device 715 that corresponds to the appropriate sorting bin 830. Multiple buttons may be assigned to the same bin or to the same set of bins for the purpose of convenience or to enable various tabulation or statistical information to be produced.

After a selection has been entered by actuation of the appropriate selection button 98, the shifted pair of documents is conveyed or incrementally advanced to a staging area 820, while the next pair of documents is conveyed or incrementally advanced to the viewing area.

The operator may also sort a selected pair of documents manually at the viewing area by pulling the selected pair of documents from the viewing area 810. When the documents are manually pulled from the viewing area, the optical sensor 90 detects the absence of the documents. In one mode of operation, if the operator removes the shifted pair of documents, such that the first optical sensor 90 is unobstructed, the next pair of documents will be automatically transported to the viewing area 810. The documents pulled from the viewing area must then be manually processed. Alternatively, the sorter apparatus 700 may function to permit the operator to remove the pair of documents for reorientation or other adjustment and then permit the operator to return the documents back into the viewing area without advancing the next pair of documents. In which case, when the operator presses one of the selector buttons 98 to designate a destination sorting bin 830 or group of sorting bins, the documents that were returned to the viewing area will be incrementally advanced to the staging area 820 and the next shifted pair of documents will be incrementally advanced to the viewing area 810, and the transport track 72 and O-ring 36 function to deliver the next pair of documents to be sorted to the viewing area 810.

Located in front of the shifted paired documents at the viewing area, are a first square tray 92, a rectangular tray 94, and a second square tray 96. These trays are removably located on the working surface of the sorting apparatus 700. The trays may be arranged in any order. Each of the trays include peripheral mounting flanges 95 that removably rest upon underlaying recessed support ledges 97 provided around the periphery of a central opening 91 on the front shelf 99 of the sorting apparatus.

The second square tray 96 functions as a keyboard input for the operator. The tray 96 contains five selector buttons 98 generally centrally positioned on the tray, as shown in FIG. 2, and a combination indicator lamp/jam clear button 101 positioned in the upper left hand corner of the tray 96. One of the five selector buttons operates as an override button 100.

Staging Area

Operation at the staging area will now be considered in greater detail. The staging area 820 is positioned along the path of movement following the viewing area 810, but still within easy reach of the operator. In the event that the shifted pairs of documents were improperly designated at the viewing area 810, the operator may correct the mistake by pressing the override button 100. Actuation of the override button 100 will cancel the initial bin designation that was entered when the documents were at the viewing area, and either send the documents to a passive bin 840, or allow a new destination bin designation to be entered, depending on the mode of operation of the apparatus.

The operator may also be permitted to manually remove the shifted pair of documents from the staging area 820, in which case an optical sensor 116 will detect the absence of the shifted documents. The sorter apparatus 700 may then operate in a first mode of operation whereby removal of the documents from the staging area by the operator automatically cancels any bin designation for the removed documents. Alternatively, the sorter apparatus 700 may permit the operator to remove and reinsert the documents at the staging area without automatically canceling the bin designation for the documents.

As the shifted pair of documents is transported from the viewing area 810 to the staging area, the documents are conveyed by transport track 72 and the O-ring conveyor 36 toward the double O-ring idler 44 whereupon the documents are transferred from the first O-ring conveyor 36 to a second O-ring conveyor 110. The second O-ring conveyer 110 is mounted on the double O-ring idler 44 and on an O-ring idler 112. The O-ring idler 112 is positioned closer to the third transport track 72 than the double O-ring idler 44. The O-ring idler 112 for the second O-ring conveyor is positioned with less of a transverse offset relative to the transport track 72 than the idlers 42 and 44 for the first O-ring conveyor 36 so that the shifted pair of documents will gradually be tilted back from the reclined viewing angle into a vertical position on the transport path 32. When the shifted pair of documents reach the O-ring idler 112, the documents encounter a second metal guide 114 which functions to maintain the vertical orientation of the documents as the documents are fed to the output area 825.

The various modes of operation at the document staging area will now be considered in greater detail. When the shifted pair of documents reach the staging area 820 from the document viewing area 810, the documents trigger the second optical sensor 116. If the operator presses the override button 100, processing of the documents will vary depending on the mode of operation of the apparatus. In a first mode of operation, the face of the indicator lamp 101 will flash twice, indicating that the selected sorting bin for the paired documents in the staging area has been canceled. The paired documents will then be sent to a passive bin 840 when the operator next causes a designation to be entered for the pair of documents located in the viewing area. In a second mode of operation, the face of the indicator lamp 101 will remain lit after activation of the override button until a new sorting selection is entered by actuation of a selector button 98 for the documents in the staging area. Actuation of a selector button 98 causes the indicator lamp 101 to go out, and normal processing of documents may resume. In the event that a pair of documents is removed from the staging area while the indicator light 101 remains lit, the second optical sensor 116 will detect that there are no documents in the staging area, and will alert the control system 500. The sorter apparatus may function to inhibit a new destination selection until the removed documents are replaced. Alternatively, the sorter apparatus may function to automatically inhibit the entry of any destination selection for the removed documents.

Document Stacker

The operation of the document stacker will now be considered. When a shifted pair of documents in the staging area 820 is conveyed to the output area 825, the documents are carried between a series of paired belts which are all driven by stacker drive motor 400. The shifted pairs of documents are directed by gates 156 to the appropriately designated sorting bins 830. If the shifted pair of documents has been designated by the override button 100 for the passive bin 840, or if a document jam has occurred, the documents are conveyed past all of the sorting bins 830 and deposited in the passive collection bin 840.

From the staging area 820, the shifted pair of documents is conveyed by the transport track 72 in cooperation with O-ring conveyor 110 to a soft nip formed between a spring loaded idler pulley 130 and a first transportation belt 134 carried on idler pulley 132. The shifted pair of documents are conveyed into the soft nip by the cooperative movement of the third transport track 72 and the third O-ring 110.

A third optical sensor 128 is positioned to detect the entry of the documents into the document stacker. From the soft nip, the shifted pair of documents become entrained between the first transportation belt 134 and an opposing first idler belt 142. The first transportation belt is carried by belt idler pulley 132, belt idler pulley 136, belt idler pulley 138, and a driver pulley 140. The first idler belt 142 is carried on idler pulley 144, idler pulley 146, idler pulley 148, and idler pulley 150. The force of contact between the transportation belt 134 and the idler belt 142, and particularly around corner pulleys 144 and 146, causes the transportation belt 134 to drive the idler belt 142. As the shifted paired documents are conveyed by the transportation belt 134 and the idler belt 142, an optional optical sensor 152 located proximate to the first driver pulley 140 may be used to detect the arrival of the documents and to signal the control system of the presence of the shifted pair of documents. As the shifted pair of documents pass the first driver pulley 140, a second transportation belt 154 cooperates with idler belt 142 to entrain the documents. The second transportation belt 154 is carried on and driven by a second driver pulley 155. The belt 154 is also carried on a set of idler pulleys 157. The pair of documents is carried between the second transportation belt 154 and the idler belt 142 until a first gate 156 leading into a first sorting bin 170 is reached along the path of movement. A series of short idler belts 158 carried on idler pulleys 159 are disposed between successive gates 156 and also between the last gate and at the passive collection bin 840. The idler belts 158 are driven by contact with transportation belt 154. The idler belts 158 function to entrain documents between the idler belts 158 and the transportation belt 154 at positions between the gates 156 and at the position between the last gate and the passive collection bin.

Figure 9:
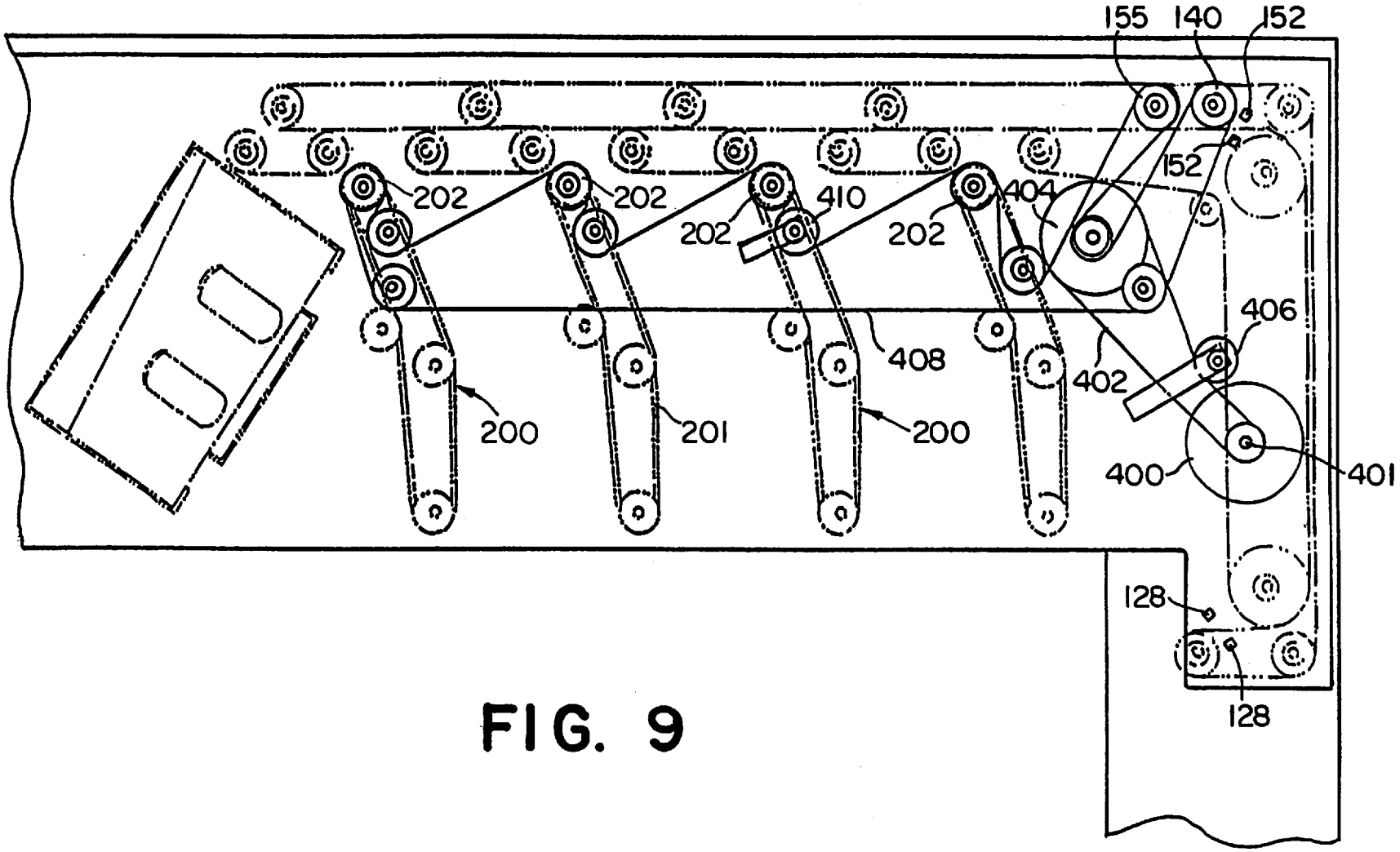
FIG. 9 is an enlarged, top schematic plan view taken below the upper surface of the document sorter unit with various structures removed and with a passive document collection bin shown in phantom to better illustrate a drive mechanism for the document transport, as also shown in phantom, for a document stacker of the document sorter unit.

As best shown in FIG. 9, the belt drive motor 400 directly or indirectly drives all of the belts and O-rings that convey the shifted pair of documents in the document stacker. The belt drive motor 400 continuously powers a first drive belt 402 which is carried on drive pulley 401 and a reducer pulley 404. The first drive belt 402 is properly tensioned by a first tensioner pulley 406. The reducer pulley 404, drives a second drive belt 408 which, in turn, drives the two driver pulleys 140 and 155 and four O-ring drive pulleys 202. The second drive belt 408 is tensioned by a second tensioner pulley 410.

Sorting Bins

A series of four sorting bins 830 is provided at the output area of the document stacker. The sorting bins 830 collect and stack pairs of documents that have been directed to each respective bin or set of bins. Each sorting bin 830 contains an optical sensor 220 to determine whether the sorting bin 830 is empty. Each sorting bin also contains an O-ring drive 200 having an O-ring conveyor 201 for conveying the pairs of shifted documents into the bins 830. The documents are conveyed against the end of the sorting bin 830 to justify the shifted pairs of documents to enable convenient stacking. The control system 500 counts the number of document pairs sent to each sorting bin. The control system causes the display of a message if a bin count equals a preselected bin count and causes the indicator light 101 to light if no other designated bins are available. In the event that no documents are present in a selected sorting bin, a bin sensor 220 for the selected sorting bin will signal the control system that the sorting bin is empty. The pairs of documents are directed into the respective bins 830 by the firing of gates 156 in response to operator inputs at the input device 715. The second transportation belt 154 functions to convey shifted pairs of documents past a total of four gates, and each gate 156 may be fired along the path of movement to direct the shifted pairs of documents to a respective sorting bin 830.

If the first gate 156 is not fired, the pair of documents is permitted to pass by the first gate 156 whereupon the pair of documents becomes entrained between the second transportation belt 154 and a short idler belt 158 which functions to transport the pair of documents to the next successive gate. If the first gate is fired, the first gate is moved into position against a first gate stop 160 to direct the shifted pair of documents against the O-ring conveyor 201 which is wrapped around the O-ring drive pulley 202, an O-ring idler 204, an O-ring idler 206, and an O-ring idler 208 as shown in FIG. 2. The O-ring 201 pulls the shifted pair of documents past a first corrugator pulley 210, which corrugates the shifted pair of documents to provide some stiffness for easier handling. As the O-ring conveyor 201 moves the shifted pair of documents into the bin, the documents engage a backer bar 212 and a tail kicker 222 directs the trailing edge of the shifted pair of documents against the backer bar 212. The backer bar 212 is attached to a first link arm 214 by a pin 216 that passes downwardly through a pin slot 218 cut into the surface of the apparatus. The backer bar 212 displaces away from the O-ring 201 as more paired documents enter the first sorting bin 170. The fourth O-ring 201 continues to move the shifted pair of documents toward the end of the first sorting bin 170. When the leading or forward shifted document of the pair of documents encounters the end of the first sorting bin 170, the leading document stops, but the trailing or backward shifted document continues to move. When the trailing document hits the end of the first sorting bin 170, movement of the trailing document is also stopped, thus edge justifying the pair of documents in the bin.

Passive Bin

A passive document collection bin 840 is provided at the end of the path of movement in the stacker. The passive bin 840 is provided to collect misdirected or jammed documents. Other types of documents, such as envelope faces or other improper documents, may also be directed to the passive bin. The shape of the passive bin 840 facilitates stacking of bent or mutilated documents.

In the event that no gates 156 are fired to direct a shifted pair of documents to one of the previous sorting bins 830, the second transportation belt 154 in cooperation with the series of idler belts 158 transports the shifted pair of documents into a third metal guide 302. The metal guide 302 directs the shifted pair of documents through a nip formed between a spring loaded idler pulley 304 and idler pulley 306 which functions to properly position the documents for input into the passive bin 840.

Figure 10:
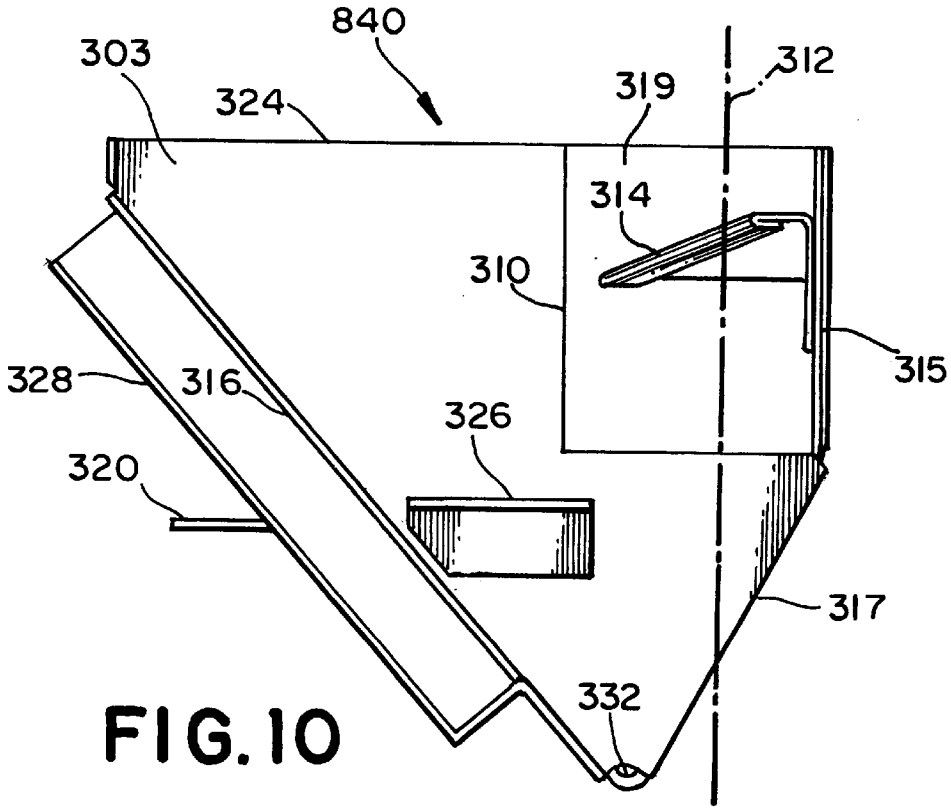
FIG. 10 is a schematic, side elevational view of the passive document collection bin of the document sorter unit.

As best shown in FIGS. 2 and 10, the passive bin 840 includes a first end wall 303 having an input opening 310 in the form of a generally square passageway. The input opening is disposed to cooperate with the document transport of the stacker to enable the document transport to convey or propel the pairs of documents into the bin through the passage 310. The bin also includes a document support wall 316 positioned at a selected angle relative to horizontal for underlaying and supporting a stack of the pairs of documents conveyed into the bin through the passageway 310. The document support wall engages a face surface of the stacker. A stacking wall 317 is positioned at a selected angle, such as an acute angle, relative to the support wall for engaging bottom edge surfaces of the pairs of documents conveyed onto the stack. The stacking wall 317 functions to support and hold the pairs of documents in the stack. A guide rail 314 is mounted on a vertically-oriented sidewall 315 in alignment with the documents passageway 310. The guide rail 314 is positioned to be in the path of movement of the documents conveyed into the bin. As documents are conveyed into the bin, the guide rail functions to deflect the documents onto the stack of documents supported by the support wall. The sidewall 315 is bent and oriented at an obtuse angle relative to the stacking wall 317. The bin also includes an end wall 319 disposed generally orthogonal to the direction of movement of the pairs of documents through the document passageway 310 into the bin. The end wall 319 is positioned generally in parallel with end wall 303. The end wall 319 functions to stop the movement of the pairs of documents conveyed into the bin.

Two oblong finger holes 318 are cut into the support wall to permit the contents of the bin to be easily removed by an operator. A finger hole closure 328 is provided on the external surface of the support wall 316 in order to contain any debris that might otherwise fall from the bin through the oblong finger holes 318. A support flange 320 projects from the outside of the support wall 316 to permit the passive bin to be mounted within the document sorter apparatus. A second support flange 326 is provided on the exterior surface of end wall 303 to also facilitate the mounting of the bin within the apparatus.

The initial path of movement of the shifted pairs of documents into the bin is through the document passageway 310 generally in vertical orientation at the position indicated by dashed reference line 312. As the shifted pairs of documents are propelled into the bin, the documents impinge upon the guide rail 314 projecting from sidewall 315. The guide rail 314 angles inwardly from sidewall 315 toward the support wall 316 as the guide rail progresses from the document passageway 310 to the opposing end wall 319. The guide rail also angles downwardly toward the bottom 332 of the passive bin 840 as the guide rail progresses from the document passageway 310 to the opposing end wall 319. The inward angling of the guide rail serves to deflect documents onto the support wall 316 as the documents enter into the bin. The downward angling of the guide rail accommodates a drop of the documents toward the bottom 332 of the bin in response to gravity as the documents are propelled into the bin.

Control System

Figure 11:
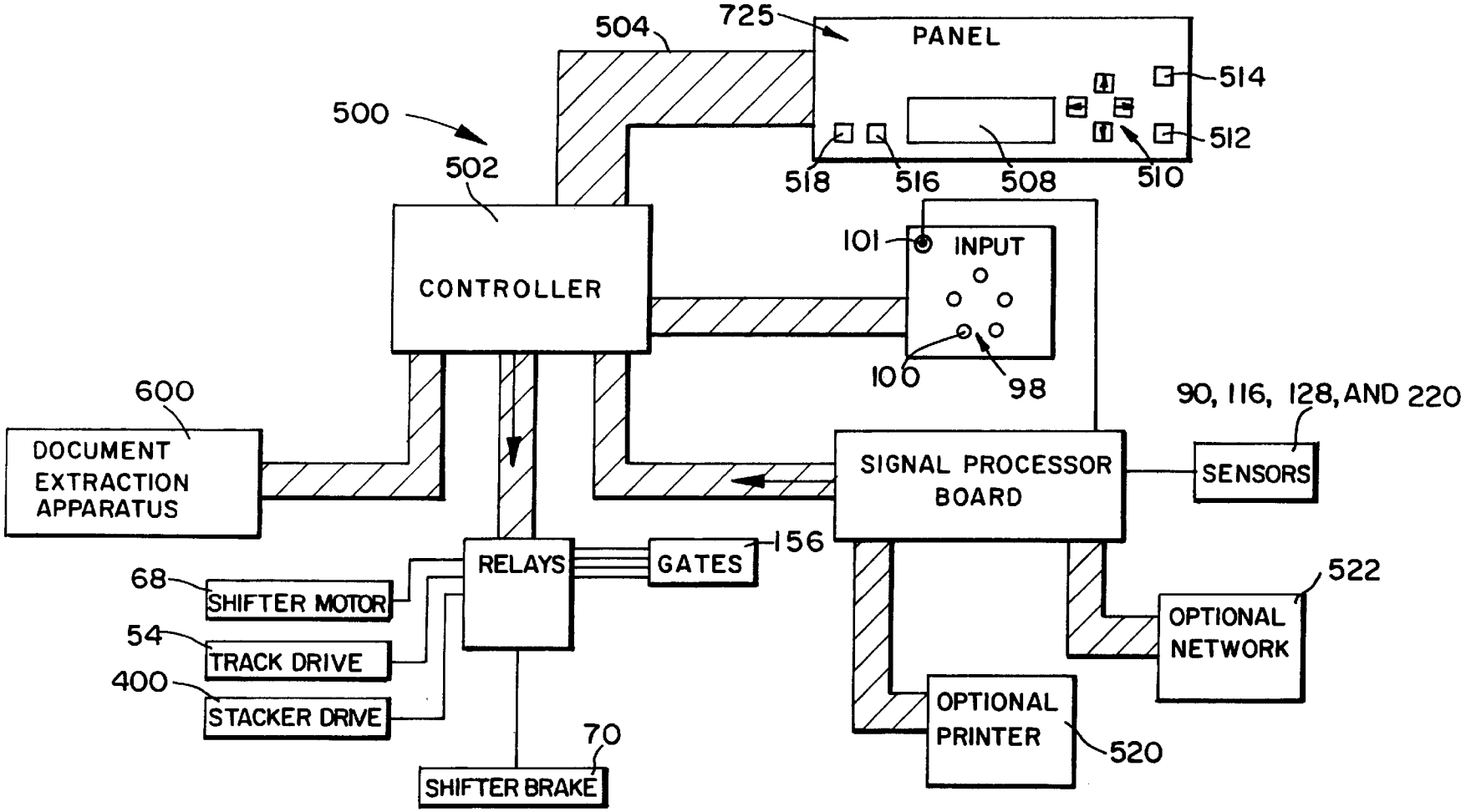
FIG. 11 is a block diagram of the electrical circuitry for the document sorter unit.

Operation of the control system 500 will now be considered in greater detail. The control system 500, as shown in FIG. 11, controls the operation of the various subsystems of the apparatus, and coordinates the various processing operations. The control system 500 includes a controller 502, which takes data from input signals and generates output signals to produce appropriate responses. An interface cable 504 connects the controller 502 to a display panel 725, which contains an LCD display 508 for displaying apparatus operating parameters and options. Four arrow keys 510 are provided on the display panel 725 to allow the operator to select options displayed on the LCD display 508. When a desired option is selected with the arrow keys 510, an enter key 512 may be pressed to confirm a selected option. If a displayed option is not desired, a cancel key 514 may be pressed to cancel the displayed option. The apparatus may be started by pressing the start key 516 and stopped by pressing the stop key 518. Additional information may be displayed using an optional printer 520 positioned at printer port 730. In addition, an optional network interface 522 allows information to be transferred to and from a host computer.

The optional printer, optional network, and the combination indicator/jam clear button 101 are connected with the controller 502 via a signal processor board. The shifter motor 68, track drive motor 54, and stacker drive motor 400 are connected with the controller 502 by AC relays. The shifter brake 70 and the gates 156 are connected with the controller 502 by DC relays.

The controller 502 also has several input control lines and output control lines. The input control lines include JAM, DOOR, CONTENT, FEED START, MOTOR START, STOP STATUS, FEED READY, VIEWING AREA, STAGING AREA, BIN 1 EMPTY, BIN 2 EMPTY, BIN 3 EMPTY, BIN 4 EMPTY, ARM SENSOR, SELECTOR BUTTON 1, SELECTOR BUTTON 2, SELECTOR BUTTON 3, SELECTOR BUTTON 4, SELECTOR BUTTON 5, INDICATOR BUTTON, and INDICATOR LIGHT. The output control lines include FEED START, MOTOR START, MOTOR STOP, SHIFTER MOTOR, SHIFTER BRAKE, TRACK FLOOR MOTOR, STACKER MOTOR, BIN 1 GATE, BIN 2 GATE, BIN 3 GATE, BIN 4 GATE, ARM END, and JAM CLEAR.

The document extraction apparatus 600 sends several signals to the control system 500 that indicate status information. The status signals include JAM, DOOR, CONTENT, FEED START, MOTOR START, STOP STATUS, and FEED READY. JAM indicates that a jam has occurred in the document extraction apparatus 600. DOOR indicates that one of the doors on the document extraction apparatus is open. CONTENT indicates that a content was detected in an envelope that was about to be discarded. FEED START indicates that the document extraction apparatus 600 is ready to feed. MOTOR START indicates that the document extraction apparatus is ready to start. STOP STATUS indicates that the document extraction apparatus 600 is in normal operation mode. FEED READY indicates the presence of an envelope in a feeder to the document extraction apparatus 600.

Several optical sensors send signals to the control system 500. The first optical sensor 90 located in the viewing area 810 sends the VIEWING AREA signal which indicates that shifted paired documents are present at the viewing area 810. The second optical sensor 116 located in the staging area 820 sends the STAGING AREA signal which indicates that shifted paired documents are present at the staging area 820. The third optical sensor 128 located at the input to the stacker sends an appropriate signal to indicate the arrival of a pair of documents at the stacker. The fourth optical sensor 220 located in the sorting bins 840 sends the BIN 1 EMPTY signal which indicates that no paired documents are present in the first sorting bin 170. Additional optical sensors, like the fourth optical sensor 220, are positioned in the other sorting bins 840. These additional sensors send the signals BIN 2 EMPTY, BIN 3 EMPTY and BIN 4 EMPTY, for each of the respective sorting bins 840. Each BIN X EMPTY signal indicates that no documents are present in the respective sorting bin 840.

The control system 500 also receives input control signals from several buttons on the document processing apparatus 700. The five selector buttons 98, send the signals SELECTOR BUTTON 1, SELECTOR BUTTON 2, SELECTOR BUTTON 3, SELECTOR BUTTON 4, and SELECTOR BUTTON 5, where each signal indicates the status of a specific button. SELECTOR BUTTON 1 indicates that the top left selector button 98 is pressed. SELECTOR BUTTON 2 indicates that the top center selector button 98 is pressed. SELECTOR BUTTON 3 indicates that the top right selector button 98 is pressed. SELECTOR BUTTON 4 indicates that the bottom left selector button 98 is pressed. SELECTOR BUTTON 5 indicates that the bottom right selector button 98 is pressed. Any one of the selector buttons 98 may be programmed as an override button 100. The INDICATOR BUTTON signal is sent to the controller 502 when the indicator/jam clear button 101 is pressed.

The control system 500 sends several output control signals to various parts of the document extraction apparatus 600 and to the documents sorter apparatus 700, including FEED START, MOTOR START, MOTOR STOP, SHIFTER MOTOR, SHIFTER BRAKE, TRACK FLOOR MOTOR, STACKER MOTOR, BIN 1 GATE, BIN 2 GATE, BIN 3 GATE, BIN 4 GATE, and ARM END.

The document extraction apparatus 600 receives the FEED START, MOTOR START, MOTOR STOP, and ARM END signals from the sorter apparatus 700. The FEED START signal commands the document extraction apparatus to start feeding paired documents to the document sorter apparatus 700. The MOTOR START signal commands the motors in the document extraction apparatus 600 to start. The MOTOR STOP signal commands the motors in the document extraction apparatus 600 to stop. The ARM END signal indicates that a paired document has arrived at the end of the arm by changing from OFF to ON. When the ARM END signal changes from ON to OFF, a new cycle of the document extraction apparatus 600 is initiated.

The controller 502 produces the SHIFTER MOTOR, SHIFTER BRAKE, and the TRACK FLOOR MOTOR signals for controlling the shifter mechanism 800. The SHIFTER MOTOR signal turns the shifter motor 68 on and off. The SHIFTER BRAKE signal turns the electromagnetic brake 70 on and off. The TRACK FLOOR MOTOR signal turns the O-ring track drive motor 54 on and off.

The sorting bins 840 receive the BIN 1 GATE, BIN 2 GATE, BIN 3 GATE, and BIN 4 GATE signals to fire the respective gates. The STACKER MOTOR signal turns the stacker drive motor 400 on and off. The BIN X GATE signals control the gates 156 to the sorting bins 840 by moving the gates 156 to either direct shifted paired documents into a specific sorting bin 840, or to direct the documents on to the next gate 156.

In addition to controlling the operation of the document extraction apparatus 600 and the document sorter apparatus 700, the control system 500 records run-time statistics and provides diagnostic functions. Some statistics that are available include the total pieces run for all jobs and the jam statistics for each jam location for all jobs. Other statistics may also be produced, for example, to tabulate the amount of entries on each input button.

Functional Description

In a preferred embodiment, the document extraction apparatus 600 and the document processing apparatus 700 will be controlled by the control system 500 to coordinate operations. The control steps used to implement the operation of the entire processing apparatus 200 include a Power Up state and a Running state.

After the power is turned ON, the document sorter apparatus 700 sets initial states of the document extraction apparatus 600 as follows: FEED START signal OFF, MOTOR START signal OFF, STOP STATUS signal OFF, ARM END signal ON or OFF depending on a status of an ARM SENSOR signal.

Figure 12:
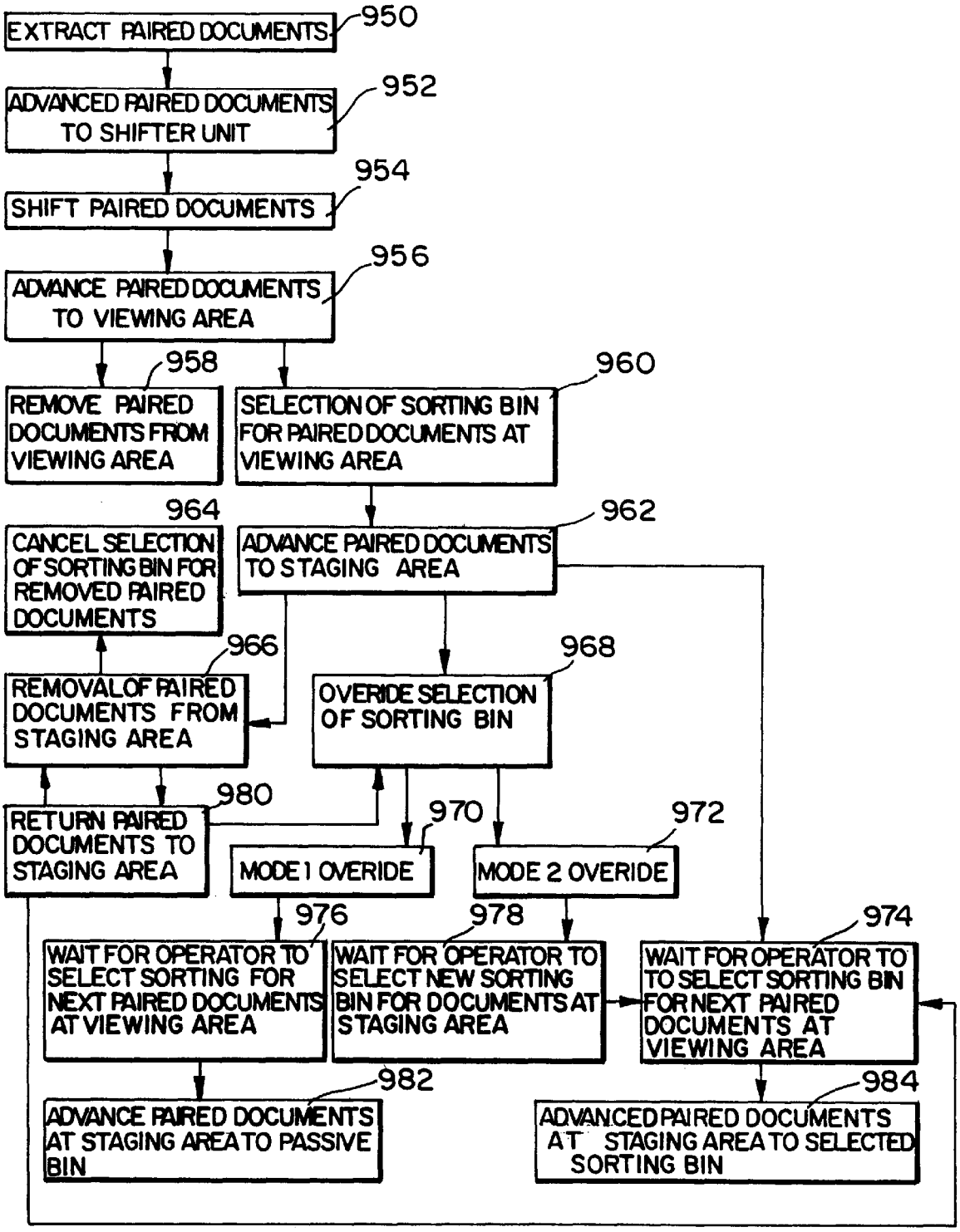
FIG. 12 is a flow chart showing the sequence of operations of the document sorter unit.

When the Power Up state is complete the document sorter apparatus 700 display panel 725 will allow an operator to login and choose from a list of jobs to run. When a job is selected and the operator presses any selector button 98, the Run State will be entered and the sequence of events shown in FIG. 12 will take place for each pair of documents.

In step 950, the document extraction apparatus 600 extracts paired documents. If the STOP STATUS signal from the document extraction apparatus 600 is ON, the STOP MOTOR output is activated and then deactivated. The JAM, DOOR, CONTENT, FEED START, and STOP STATUS signals from document extraction apparatus 600 are verified to be OFF and the MOTOR START signal from the document extraction apparatus 600 is verified to be ON, otherwise a Jam message is displayed on the LCD display 508. The MOTOR START signal is activated and then deactivated. Next, the FEED START signal from the document extraction apparatus 600 is verified to be ON, otherwise a Jam message is displayed on the LCD display 508. The FEED START signal output is activated and then deactivated. Next, the MOTOR STOP signal from document extraction apparatus 600 is verified to be on, otherwise a Jam message is displayed on the LCD display 508. Afterwards, the STACKER MOTOR signal is turned ON. At this point, the document extraction apparatus 600 will start normal operation. Step 952 immediately follows.

In step 952, paired documents are advanced to the shifter mechanism 800. The control system 500 waits for the ARM SENSOR input to become blocked to determine when the paired documents have advanced to the shifter mechanism 800. If a timeout occurs, a Jam will be displayed on the LCD display 508. The timeout duration "Full Cycle Time" is obtained from a machine parameter for the document extraction apparatus 600. The control system 500 waits for a second timeout to expire before the paired documents are considered ready for shifting. The second timeout duration "Justify Time" is obtained from a machine parameter. During the second timeout duration, the second transport track 32 on the document extraction apparatus 600 will run, pushing paired documents against the feed wheel 60 and the brake wheel 62 to ensure front end justification of the paired documents. When the paired documents are justified, the ARM END output to the document extraction apparatus 600 is activated to command the document extraction apparatus 600 to stop feeding and to stop the first and second transport tracks 30, 32. Step 954 is performed as soon as the paired documents are present and justified.

In step 954, the paired documents are shifted. The SHIFTER BRAKE, SHIFTER MOTOR, & TRACK FLOOR MOTOR signals may be timed off of the ARM SENSOR. First, the SHIFTER MOTOR signal turns on the shifter motor 68 and the TRACK FLOOR MOTOR signal turns on the O-ring track drive motor 54. After a timed interval "Pair entry time" obtained from a machine parameter expires, the SHIFTER BRAKE signal turns on the electromagnetic brake 70 for a second time interval, obtained from Job parameter "Shift time", and then the SHIFTER BRAKE signal turns off, allowing the brake wheel 62 to turn and the documents to be conveyed together to the third transport track 72, where step 956 is performed.

In step 956, the paired documents are advanced along the third transport track 72 until the paired documents reach the viewing area 810, at which point the O-ring track drive motor 54 is turned off. Step 958 is performed if paired documents are removed from the viewing area 810, otherwise step 960 is performed.

In step 960, the operator may press one of the selector buttons 98 to select a sorting bin 840 for the paired documents in the viewing area 810, at which point, the paired documents will be advanced to the staging area 820 in step 962.

In step 962, the paired documents are advanced along the third transport track 72 to the staging area 820, while the ARM END output to the document extraction apparatus 600 is deactivated. At this time the document extraction apparatus 600 starts the next cycle and the SHIFTER BRAKE signal is turned OFF, the SHIFTER MOTOR signal is turned ON, and TRACK MOTOR signal is turned ON. From step 962, step 974 will be performed if the selector button 98 is pressed to select a sorting bin 830 for paired documents in the viewing area, or step 966 will be performed if the override button 100 is pressed, or step 968 will be performed if the paired documents are removed from the staging area.

In step 974, paired documents wait in the staging area 820 until a selector button 98 is pressed. When the selector button 98 is pressed, a timeout counter obtained from machine parameters "Gate X on time" and "Gate X off timer" is started and step 984 is performed.

In step 984, the paired documents in the staging area 820 are advanced to the selected sorting bin 840. When "Gate X on time" timeout expires, the appropriate BIN GATE signal is turned ON and when "Gate X off timer" timeout expires the appropriate BIN GATE signal is turned OFF. Next, a BIN count for the GATE that was turned ON in the previous step is incremented. If the BIN count becomes equal to the Preselected Bin Count, and there are no other sorting bins 840 assigned to this Group, "Bin X is full" is displayed on the LCD display 508 and the Bin X empty sensor 220 is monitored. If the sorting bin 840 becomes emptied, the Bin count is cleared.

In step 966, the selection of a sorting bin for the documents in the staging area 820 is overridden by pressing the override button 100. If override mode one is in effect, step 970 is performed, otherwise if override mode two is in effect, step 972 is performed.

In step 970, a light in the face of the jam clear button 101 flashes twice to indicate that override mode one is in effect and step 976 is then performed.

In step 976, the paired documents wait at the staging area 820 until the operator selects a sorting bin 830 for the paired documents at the viewing area 810 by pressing a selector button 98, after which, step 982 is performed.

In step 982, the paired documents in the staging area are advanced past the sorting bins 830 and into the passive bin 840.

In step 972, a light in the face of the jam clear button 101 remains lit to indicate that override mode two is in effect and that operator input is required, after which, step 978 is performed.

In step 978, the paired documents wait at the staging area 820 until the operator selects a new sorting bin for the paired documents at the staging area 820 by pressing a selector button 98. When a selector button is pressed, the light in the jam clear button 101 is turned off and step 974 is performed.

In step 968, the optical sensor 116 in the staging area can detect the presence or absence of the paired documents. If the paired documents are returned to staging area 820 at step 960, step 968 may be repeated. Otherwise, either step 966 or step 974 may be preformed. If the paired documents are not returned to the staging area 820 at step 960, step 964 is performed so that the sorting bin 840 selection for the removed paired documents is canceled.

The document processing apparatus 200 may perform in various other modes of operation. For example, the apparatus may be used to process and sort single documents instead of document pairs. The apparatus may also be used to process multiple documents greater than just a pair of documents. In this type of operation, the shifter would function to shift back the top document of the set. The apparatus may also be used to process and sort pairs or sets of documents without using the shifter mechanism. If a suitable sorting criteria appears on the exposed document of the document pair, shifting of the documents is no longer necessary. On the other hand, the apparatus can be used to fully singulate parallel pairs of documents into a serial flow. In addition, a scanning device could be incorporated to verify whether documents passing the scanning device have a selected characteristic. The shifter mechanism could then be activated to selectively shift those sets of documents having the selected characteristics. Operation of the apparatus can also be modified to produce a continuous flow of documents through the sorter apparatus without pausing the documents in the viewing area. In a continuous flow method of operation, the operator could designate a bin destination while the documents move through the viewing area.

It will be recognized by those skilled in the art that changes or modifications may be made without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A document processing apparatus for processing pairs of documents arranged in a generally parallel relationship comprising:

a) a document transport for conveying the pairs of documents along a selected path of movement;

b) a document shifter positioned along the path of movement for partially shifting one document of each pair of documents relative to the other document of each pair of documents along the path of movement to at least partially expose a selected portion of one of the documents of each such pair of documents;

c) a document viewing area positioned along the path of movement to present the shifted pair of documents for visual inspection by an operator to enable visual inspection of a selected criteria on the pair of documents including the at least partially exposed portion of the one document; and d) an operator input device for operably controlling a selected path of movement of each pair of documents in response to an operator input, the operator input device having a selection actuator operable by the operator to designate a selected path of movement for each pair of documents in response to visual detection of the selected criteria.

2. The apparatus of claim 1 comprising a control system for controlling operation of the document transport for enabling the document transport to pause movement of each pair of documents at the document viewing area.

3. The apparatus of claim 1 comprising a document recliner positioned at the document viewing area in order to support each pair of shifted documents at a selected angle of recline for visual inspection by the operator.

4. The apparatus of claim 1 wherein the document transport includes a conveyor track for carrying pairs of documents to the document viewing area and wherein the document transport includes a moving conveyor element cooperating with the conveyor track for engaging an upper portion of each pair of shifted documents such that the upper portion of each pair of documents rests upon the moving conveyor element so that moving conveyor element cooperates with the conveyor track to convey the pairs of documents to the document viewing area.

5. The apparatus of claim 4 wherein the moving conveyor element is offset from the conveyor track in a generally perpendicular direction relative to the path of movement in order to support the pairs of documents at a selected angle of recline at the viewing area for visual inspection by the operator.

6. The apparatus of claim 1 wherein the document shifter includes a pair of nip rollers for engaging each pair of documents along a selected path of movement, the nip rollers advancing one document of each pair of documents relative to the other document of each pair of documents along the selected path of movement to at least partially shift the one document relative to the other document along the path of movement.

7. The apparatus of claim 6 wherein the nip rollers include a driven roller and a passive roller, the driven roller functioning to advance the one document relative to the other document along the path of movement.

8. The apparatus of claim 7 including a brake for retarding movement of the passive roller to permit the one document to be shifted relative to the other document along the path of movement.

9. The apparatus of claim 1 comprising a detector positioned at the document viewing area for detecting the presence of a pair of documents at the document viewing area and wherein the apparatus comprises a control system for the document transport for pausing movement of the pair of documents at the document viewing area and wherein the detector detects any removal of the pair of documents from the viewing area during a pause in movement of the pairs of documents at the viewing area and in response to the removal of the documents the control system causes the document transport to convey a new pair of shifted documents from the document shifter to the document viewing area.

10. The apparatus of claim 9 wherein the control system causes the document transport to terminate the pause of the pair of documents at the document viewing area and to convey the pair of documents from the document viewing area in response to activation of the selection actuator by the operator prior to any removal of the pair of documents from the viewing area.

11. The apparatus of claim 1 comprising a control system for the document transport, the control system causing the document transport to pause movement of each pair of documents at the document viewing area and wherein the control means causes the document transport to terminate the pause and to convey the pair of documents positioned in the document viewing area from the document viewing area in response to activation of the selection actuator by the operator.

12. The apparatus of claim 1 comprising a document staging area positioned after the document viewing area along the path of movement wherein the document transport pauses movement of the pair of documents at the document staging area to permit visual inspection of the pair of documents by the operator at the document staging area.

13. The apparatus of claim 12 including an override actuator for canceling the selected path of movement designated by the operator with the selection actuator when the pair of documents were positioned at the document viewing area.

14. The apparatus of claim 13 including an indicator for indicating to the operator whenever the override actuator is activated by the operator.

15. The apparatus of claim 13 including a detector positioned at the document staging area for detecting the presence of a pair of documents at the document staging area.

16. The apparatus of claim 15 wherein the detector detects the removal of a pair of documents from the document staging area during a time that a the pair of documents are paused at the document staging area and wherein the apparatus includes a control system responsive to the removal of the pair of documents from the document staging area during a pause in movement of the pair of documents at the document staging area to cancel the selected path of movement designated by the operator for such pair of documents.

17. The apparatus of claim 13 including a control system for the document transport responsive to the actuation of the override actuator to cancel the designation of the selected path of movement for the pair of documents.

18. The apparatus of claim 17 wherein the control system is responsive to the actuation of the selection actuator following an actuation of the override actuator to designate a new selected path of movement for the documents positioned at the document staging area.

19. The apparatus of claim 18 including an indicator for providing indication to the operator of the actuation of the override actuator by the operator.

20. The apparatus of claim 19 wherein the indicator provides indication to the operator of the actuation of the override actuator until the operator actuates the selection actuator to designate the new selected path of movement.

21. The apparatus of claim 20 wherein the indicator is provided as a visual indicator.

22. The apparatus of claim 1 including an output area positioned along the path of movement following the document viewing area for collecting pairs of documents in designated groups corresponding to the selected paths of movement designated for the pairs of documents.

23. The apparatus of claim 22 wherein the output area includes a document collection bin comprising:

a) a first end wall having an input opening cooperating with the document transport to enable the document transport to convey documents into the bin;

b) a support wall positioned at a selected angle relative to horizontal for underlying and supporting a face surface of a stack of the pairs of documents conveyed into the bins through the input opening;

c) a stacking wall positioned at a selected angle relative to the support wall for engaging a bottom surfaces of the pairs of documents conveyed onto the stack for supporting and holding the pairs of documents in the stack;

d) a guide rail mounted on the stacking wall in alignment with the input opening for guiding pairs of documents onto the stack of documents supported by the support wall; and e) an end wall disclosed generally orthogonal to the direction of movement of the pairs of documents through the input opening to stop movement of the pairs of documents conveyed into the bin through the input opening.

24. The apparatus of claim 23 wherein the support wall includes a finger slot to facilitate removal of the stack of documents from the bin.

25. The apparatus of claim 1 comprising a document extractor for extracting pairs of documents from envelopes and for directing the pairs of documents in a generally parallel relationship onto the document transport.

26. The apparatus of claim 25 wherein the document extractor includes a conveyor arm positionable in registry with the document transport for conveying the pairs of parallel documents from the document extractor onto the document transport.

27. The apparatus of claim 26 wherein the conveyor arm is configured to plug into the document transport.

28. The apparatus of claim 1 comprising a generally horizontal working surface for the operator, the working surface having a support opening and wherein the operator input device includes a keypad removably positionable at selected positions along the support opening.

29. The apparatus of claim 28 wherein the keypad includes peripheral mounting flanges and the support opening includes a recessed support ledge for removably supporting the mounting flanges of the keypad.

30. The apparatus of claim 1 wherein the document transport conveys the pairs of documents in at least partially overlapping relation.

31. The apparatus of claim 30 wherein the document shifter maintains the pairs of documents in at least partially overlapping relation.

32. The apparatus of claim 1 wherein the document shifter shifts one document of each pair of documents relative to the other document of each pair of documents so that the pair of documents are at least partially overlapping and a selected portion of one of the documents of each such pair is exposed.

33. The apparatus of claim 1 wherein the selected portion of one of the documents of each such pair of documents is less than the entire document.

34. The apparatus of claim 30 wherein the selected portion of one of the documents of each such pair of documents is less than the entire document.

* * * * *